US005530414A

United States Patent [19]

Reynolds

[11] Patent Number: 5,530,414

[45] Date of Patent: Jun. 25, 1996

[54] SWITCHING ACCESSORY FOR USE WITH MOTOR STARTERS

[75] Inventor: Stanford W. G. Reynolds, Pinetown, South Africa

[73] Assignee: Saftronics, Inc., Fort Meyers, Fla.

[21] Appl. No.: 305,463

[22] Filed: Sep. 12, 1994

[30] Foreign Application Priority Data

Sep. 15, 1993 [ZA] South Africa ..... 936805

[51] Int. Cl.[6] ..... H01H 67/02

[52] U.S. Cl. ..... 335/126; 200/50.27

[58] Field of Search ..... 335/126; 200/50 AA; 361/335–7, 338, 339, 343, 344, 345

[56] References Cited

U.S. PATENT DOCUMENTS

| | | | |
|---|---|---|---|
| 3,299,347 | 1/1967 | Torii . | |
| 3,896,480 | 7/1975 | Harnden, Jr. . | |
| 3,955,122 | 5/1976 | Maynard et al. . | |
| 4,042,860 | 8/1977 | Woods et al. . | |
| 4,086,452 | 4/1978 | Collins | 200/50 AA |
| 4,128,870 | 12/1978 | Knobloch et al. . | |
| 4,137,490 | 1/1979 | Brozoski et al. . | |
| 4,161,016 | 7/1979 | Born et al. . | |
| 4,205,434 | 6/1980 | Brozoski et al. . | |
| 4,224,663 | 9/1980 | Maiese et al. . | |
| 4,243,894 | 1/1981 | Kuntner et al. . | |
| 4,398,097 | 8/1983 | Schell et al. . | |
| 4,670,817 | 6/1987 | Whitehead et al. . | |
| 4,672,248 | 6/1987 | Heyne et al. . | |
| 4,683,515 | 7/1987 | Beihoff et al. . | |
| 4,712,030 | 12/1987 | Lakin et al. . | |
| 4,769,744 | 9/1988 | Neugebauer et al. . | |
| 4,789,919 | 12/1988 | Cox et al. | 361/339 |
| 4,809,153 | 2/1989 | Bremer et al. . | |
| 4,943,890 | 7/1990 | Schaltenbrand et al. . | |

FOREIGN PATENT DOCUMENTS

| | | |
|---|---|---|
| 0526071A2 | 7/1992 | European Pat. Off. . |
| 2800041 | 7/1979 | Germany . |
| WO91/05358 | 4/1991 | WIPO . |

OTHER PUBLICATIONS

Brochure, "Redistart™ Solid State Reduced Voltage Starter," Benshaw, Inc.

*Primary Examiner*—Lincoln Donovan
*Attorney, Agent, or Firm*—Arnold, White & Durkee

[57] ABSTRACT

A switching accessory is provided for use with motor starters. In a first embodiment the accessory may be utilized as a motor starter by-pass. In another embodiment the accessory may be utilized as a motor starter isolator. The switching accessory utilizes lever action and fulcrum points to open and close contacts as desired. More particularly, the switching accessory includes a pull bar contactor arrangement, an actuator mechanism, a fulcrum shaft and an operator lever. The pull bar contactor arrangement may be axially displaceable between pairs of bus bars to permit electrical connections between the bus bars of each pair. The pull bar may be movable between a first position in which the contacts of the bus bars of each pair are isolated from one another and a second position in which the contacts of the bus bars of each pair are in electrical contact via contact elements on the pull bar. The actuator mechanism may be motor driven for linearly displacing an actuator member between predetermined limit positions. The fulcrum shaft is axially displaceable between two predetermined limit positions. The operating lever is pivotally connected to the pull bar, the actuator member of the actuator mechanism and the fulcrum shaft. The arrangement of the pull bar, the actuator mechanism, the fulcrum shaft and the operating lever may be such that, with predetermined biasing forces of biasing means acting on the fulcrum shaft and the pull bar, the operation of the actuator mechanism creates the desired electrical connection through a series of movements of the components of the accessory.

31 Claims, 4 Drawing Sheets

10
11
2
28
2
12.1
12.2
12.3
8
26
2

11
10
22
30
32
42
28
36
34
40
38
44
24
56
62
50
48
46
Y
Z
X
60
58
52
26
68
15
20
18
14
20
18
14
20
18
14
27
16
12.1
12.2
12.3

Fig. 5
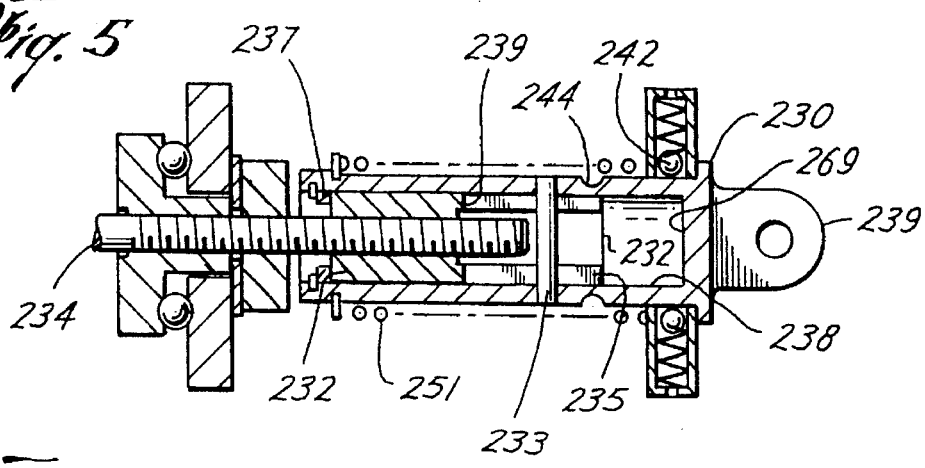
Fig. 5A
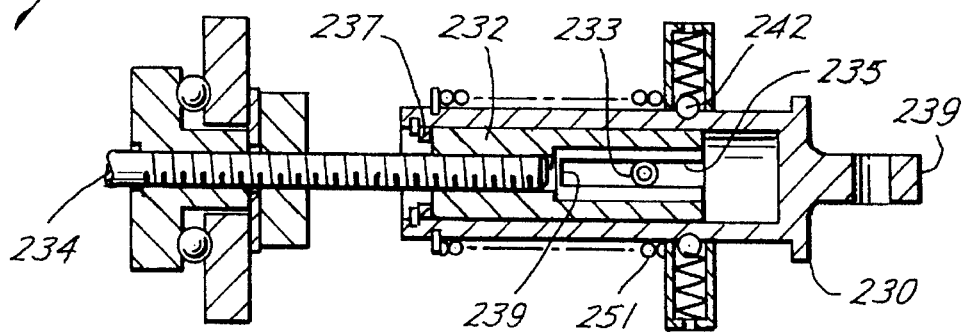
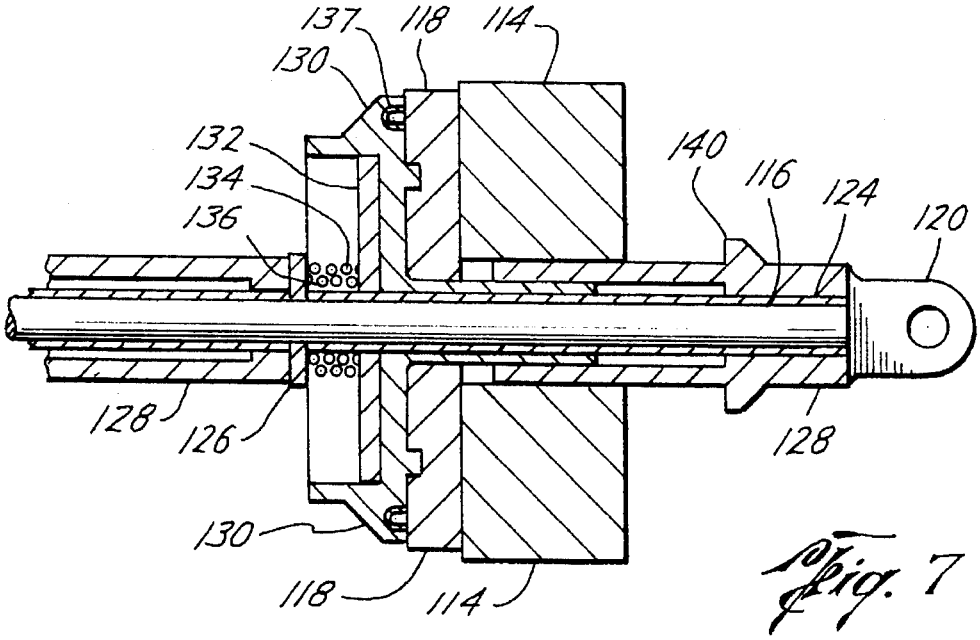
Fig. 7

SWITCHING ACCESSORY FOR USE WITH MOTOR STARTERS

BACKGROUND OF THE INVENTION

The present invention relates to motor starters. More particularly, the invention relates to a motor starter apparatus and method utilizing a current by-pass and/or current isolator arrangement.

It is known that when certain electric motors are started they can draw up to ten times their rated current for a limited period. Thus, motor starters are utilized to control the electric current supplied to the motor. A common method of controlling current utilized by motor controls is the use of thyristors or SCR's. However, a drawback to using SCR's is the large amount of heat generated. For example, typically a 1.5 volt drop occurs across each pair of thyristors of a motor starter and for a three-phase 600 ampere starter, this generates about 2.5 kilowatts of undesirable heat, which requires substantial cooling. This problem has been alleviated in the prior art by employing a switching mechanism that includes a by-pass arrangement connected in a parallel with the motor starter. After the motor has been started, the by-pass allows current to by-pass the thyristors and thus, lessen the heat dissipated by the motor starter.

An isolator arrangement is another switching mechanism often utilized in motor starters. An isolator arrangement is connected in series between the motor and the current source and is commonly required in order to permit isolation of the motor from the current source. Typical by-pass arrangements and isolator arrangements incorporate the use of fully rated, high performance contactors that are both very bulky and expensive. Also such arrangements are typically separate stand alone mechanisms that need substantial control power and have to be hard-wired or bussed into the associated circuits. Accordingly, it is an object of this invention to provide means whereby the above problems associated with the starting of motors are at least alleviated.

U.S. Pat. No. 4,953,890 contemplates a bypass and isolator arrangement utilizing solenoids that are directly mounted on the motor starter assembly rather than a separate stand alone mechanism. The solenoids are used to move and hold movable contacts which engage the stationary contact surfaces for the bypass and isolator arrangements. However, utilizing solenoids to tnove and hold contactors for bypass and isolator purposes is undesirable for a number of reasons.

For example, the typical bypass and isolator switching times required for motor starters is on the order of seconds while solenoids operate in a fraction of a second, an unnecessary speed which is obtained at the sacrifice of the high cost of solenoids. Thus, the solenoid is an unnecessarily expensive approach and it is desirable to utilize a more cost effective bypass and isolator approach. Furthermore, the energy needed to drive a solenoid contactor arrangement closed is large. Solenoids, therefore, require the use of an undesirably large transformer. This further increases the size, costs, and power consumption of the motor starter. Solenoids also create an unde, sirable high impact on the contact surfaces. Accordingly, it is an object of this invention to provide means whereby the above problems associated with the use of solenoids are at least alleviated.

SUMMARY OF THE INVENTION

In general, the contactor arrangement according to the present invention utilizes a pull bar contactor arrangement that is axially displaceable between pairs of bus bars in order to provide for the required electrical contact between the bus bars of each pair. The pull bar is moved and held in position by the lever action of an operating lever that pivots about fulcrum points.

The accessory in accordance with a first aspect of the invention serves particularly as a by-pass for the thyristors of a thyristor-type motor starter. However, an accessory of the type defined also can be connected in series with the motor starter via suitable bus bars and through a similar operation can fulfil the function of an isolator that can be used for emergency situations where, for example, the thyristors of the motor starter have failed or where motor isolation is required for maintenance or any other purposes. As such, according to a second aspect of the invention there is provided an accessory that can serve as an isolator for an electric motor and which incorporates essentially the features of the accessory in accordance with the first aspect of the invention, except insofar as they provide for the by-pass of the thyristors of an associated motor starter.

According to one embodiment of the present invention, a switching accessory includes a pull bar contactor arrangement, an actuator mechanism, a fulcrum shaft and an operator lever. The pull bar contactor arrangement may be axially displaceable between pairs of bus bars to permit electrical connections between the bus bars of each pair. The pull bar may be displaceable between a first position in which the contacts of the bus bars of each pair are isolated from one another and a second position in which the contacts of the bus bars of each pair are in electrical contact via contact elements on the pull bar. The actuator mechanism may be motor driven for linearly displacing an actuator member between predetermined limit positions. The fulcrum shaft is axially displaceable between two predetermined limit positions. The operating lever is pivotally connected to the pull bar, the actuator member of the actuator mechanism and the fulcrum shaft.

Generally, for accessories in accordance with the invention, the operating lever may be displaced by an actuator mechanism driven by any suitable movement mechanism, for example an electric motor, that can generate the necessary forces to permit the effective operation of the accessory of the invention. An actuator member of the actuator mechanism is slidably located on a nut displaceable on a threaded shaft connected to the motor via a gear box. An actuator spring is located in a configuration in which it is operable between the nut and the actuator member. For the displacement of the actuator member from its datum position to its first position, the nut acts directly on the actuator member for its displacement. For the reverse displacement of the actuator member, the nut acts on the actuator member via the actuator spring, or alternatively, the nut acts directly on the actuator member.

A detent holding mechanism may comprise a spring loaded detent that can cooperate with a detent shoulder defined by the actuator member, permitting the actuator member to be held in its holding position while the nut is displaced in its reverse direction, causing loading of the actuator mernber by the actuator spring being compressed. The detent and detent shoulder cooperated until detent force is overcome, thus permitting a snap action release of the actuator member as a result of the compressed actuator spring. The force of the spring acting on the detent and the configuration of the detent shoulder are such that release will occur in a controlled manner when a predetermined force acting on the actuator member by the spring is reached.

The fulcrum shaft may be displaceable from its datum position into its operating position against the force of a spring. A solenoid holding mechanism is used for holding the fulcrum shaft in this operating position. The solenoid holding mechanism may comprise an armature that may be positioned by the magnetic force of a solenoid. The armature can roll into its holding position when the fulcrum shaft is displaced into its operating position. The solenoid can hold the armature in the holding position against the force of a spring acting on the armature, biasing the armature into its inoperative position. As such, by shutting down the power supply to the solenoid, the force of the spring will displace the armature into its inoperative position, permitting the fulcrum shaft to return to its datum position under the force of the spring acting thereon. A suitable backing plate is provided to serve as a support for the armature, whereas the roller formation is provided to act between the armature and the fulcrum shaft so that a rolling action will ensure displacement of the armature into its inoperative position, providing for displacement of the pull bar into its first position.

According to a preferred embodiment of the invention, the pull bar contactor arrangement, the actuator mechanism and the fulcrum shaft are operable in parallel with one another, with the fulcrum shaft being disposed between the actuator mechanism and the pull bar contactor arrangement. This provides for a very compact accessory that can be associated with a thyristor motor starter for an A.C. motor that can fulfill the function of either a by-pass or an isolator.

Biasing forces provided by the various springs operating on the actuator member, the fulcrum shaft and on the contact elements of the pull bar will be such that they control the effective operation of the accessory, as do the biasing forces provided by the detent spring serving to act on the detent for holding the actuator member in its holding position and the spring acting on the armature for displacing it into its inoperative position when the associated solenoid is de-energized. The arrangement of the pull bar, the actuator mechanism, the fulcrum shaft and the operating lever may be such that, with predetermined biasing forces of biasing means acting on the fulcrum shaft and the pull bar, the operation of the actuator mechanism creates the desired electrical connection through a series of movements of the components of the accessory.

Firstly, through forward operation of the actuator mechanism, the actuator member of the actuator mechanism is axially displaced from a datum position to a first position. During displacement of the actuator mechanism from the datum position to its first position, the operating lever is pivotally displaced about a first fulcrum point provided by the point of connection between the pull bar and the operating lever. The resulting displacement of the operating lever allows for the linear displacement of the fulcrum shaft from its datum position to an operating position in which the fulcrum shaft is releasably held by an electrically energizable first holding mechanism for as long as the first holding mechanism remains energized.

Secondly, by the initial reverse operation of the actuating mechanism, the actuating member is axially displaced back towards its datum position into a holding position in which it is held by a second holding mechanism. Thirdly, by the continued reverse operation of the actuating mechanism, the actuating member is held in its holding position and is loaded for displacement back towards its datum position by a biasing arrangement, for example a spring arrangement. The movement and loading of the actuating member described above in the first, second and thiird steps may vary slightly for an alternative embodiment of the actuator member. In the alternative embodiment, during the movement of the actuating member from its datum position to its first position the actuating member is also loaded for displacement back towards its datum position by a biasing arrangement. During the initial reverse operation of the actuating mechanism, the actuating member is already loaded and is held in its holding position by a second holding mechanism.

Fourthly, by the continued reverse operation of the actuating mechanism, the second holding mechanism releases the loaded actuating member permitting, by a snap action, its displacement back to its datum position. As the actuating member returns to its datum position, the operating lever pivots about the fulcrum shaft (which is still held in its operating position by the first holding mechanism), thus, simultaneously causing snap displacement of the pull bar into its second position.

Fifthly, by the continued reverse operation of the actuating mechanism, an increased biasing force is applied to the pull bar via the operating lever for increasing the contact forces acting between the contact elements of the pull bar and the bus bar contacts contacted thereby. When predetermined contact forces are reached, the actuating mechanism switches off and a hold position is provided in which the accessory remains static until power supply to the first holding mechanism of the fulcrum shaft is cut, permitting release of the fulcrum shaft for displacement to its datum position and resulting displacement of the pull bar to its first position, thus mechanically disconnecting the bus bar pairs.

DESCRIPTION OF THE DRAWINGS

FIGS. 5 and **5*a*** illustrate schematically a cross-section of an alternative embodiment of the actuator mechanism in accordance with the present invention.

Figure 6:
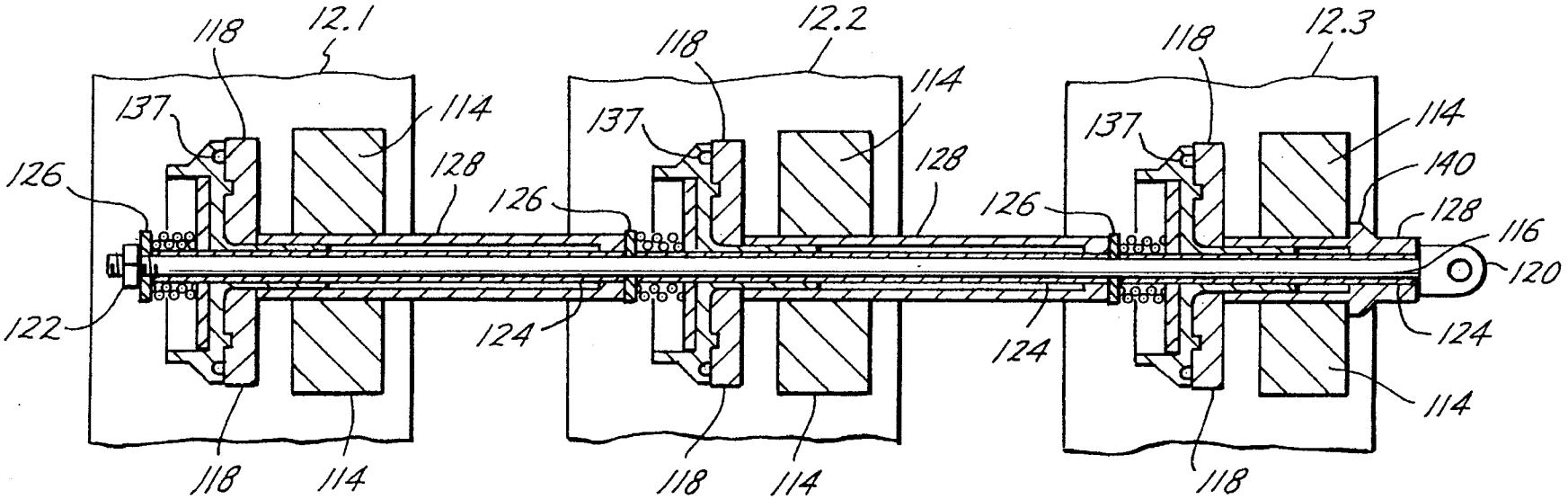
FIG. 6 illustrates an embodiment of a pull bar assembly in a contacts open configuration.
Figure 6A:
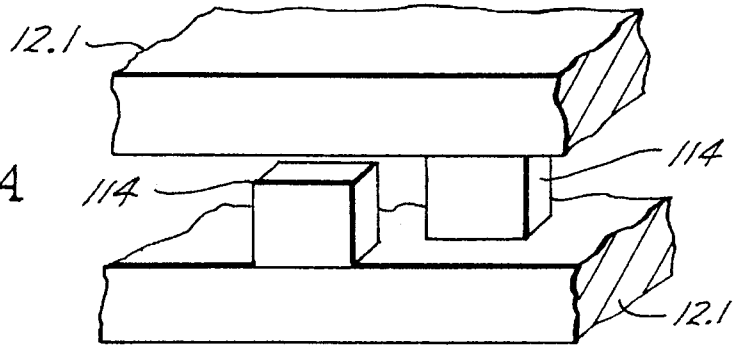

FIG. **6*a* filustrates the attachment of contacts to the bus bars for the pull bar assembly of FIG. 6**.

FIG. 7 illustrates schematically a cross-section of an expanded view of a portion of the pull bar assembly of FIG. 6 in a contacts closed configuration.

DETAILED DESCRIPTION

Figure 1:
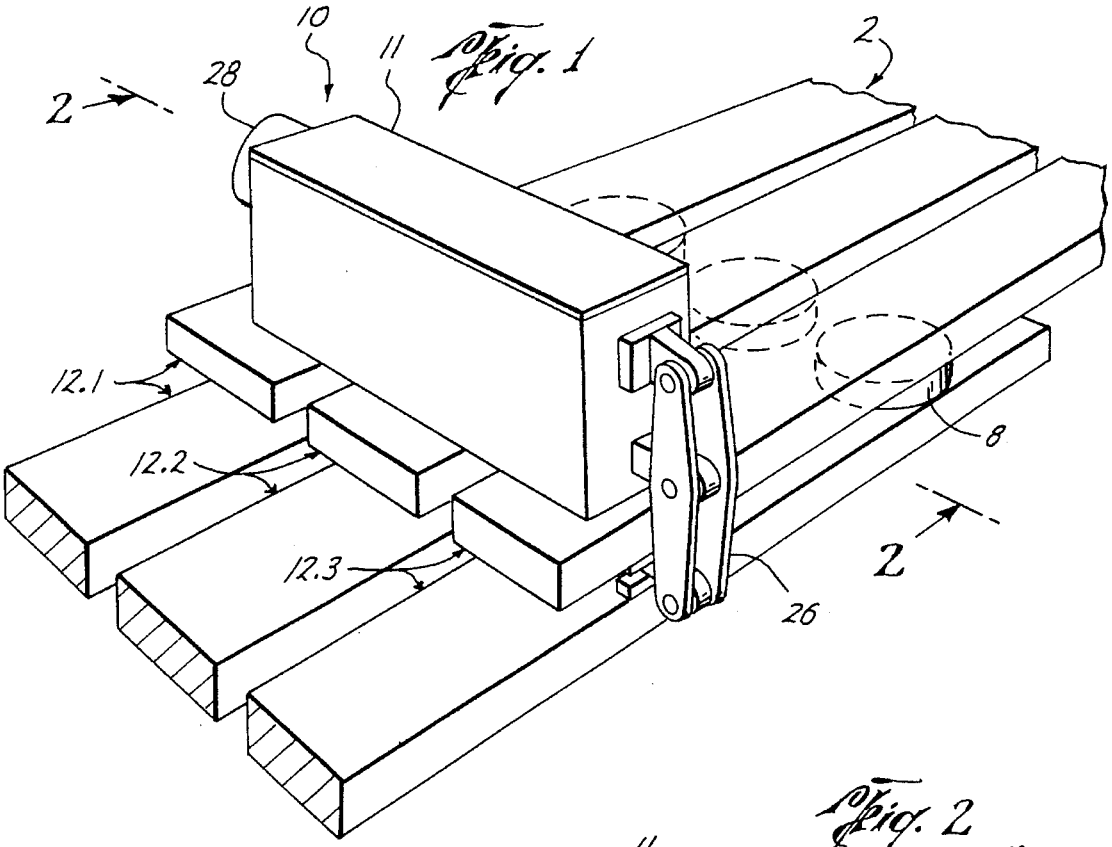
FIG. 1 illustrates generally the configuration of a motor starter having a switching mechanism accessory in accordance with the present invention.

FIG. 1 illustrates generally a motor starter 2 having a switching accessory according to the present invention. The motor starter 2 includes typical features such as three bus bars pairs 12.1, 12.2, and 12.3 for conducting current to and from the motor starter 2. As shown in FIG. 1, each bus bar pair includes an upper and lower bus bar. Though not shown, each bus bar 12.1, 12.2 and 12.3 may be surrounded by an insulator such as polycarbonate, nylon, or other suitable thermoplastic insulator. The motor starter 2 also includes devices for providing the desired current characteristics such as thyristors 8. In order to provide the required starting electric current to a motor (not shown) the three pairs of bus bars, 12.1, 12.2, and 12.3 are connected in series with a power supply (not shown), the thyristors, and the motor. As shown in FIG. 1, the motor starter 2 also includes a switching accessary 10 in accordance with the present invention. Switching accessory 10 includes an outer housing 11, operating lever 26, and a DC motor 28.

Figure 4:
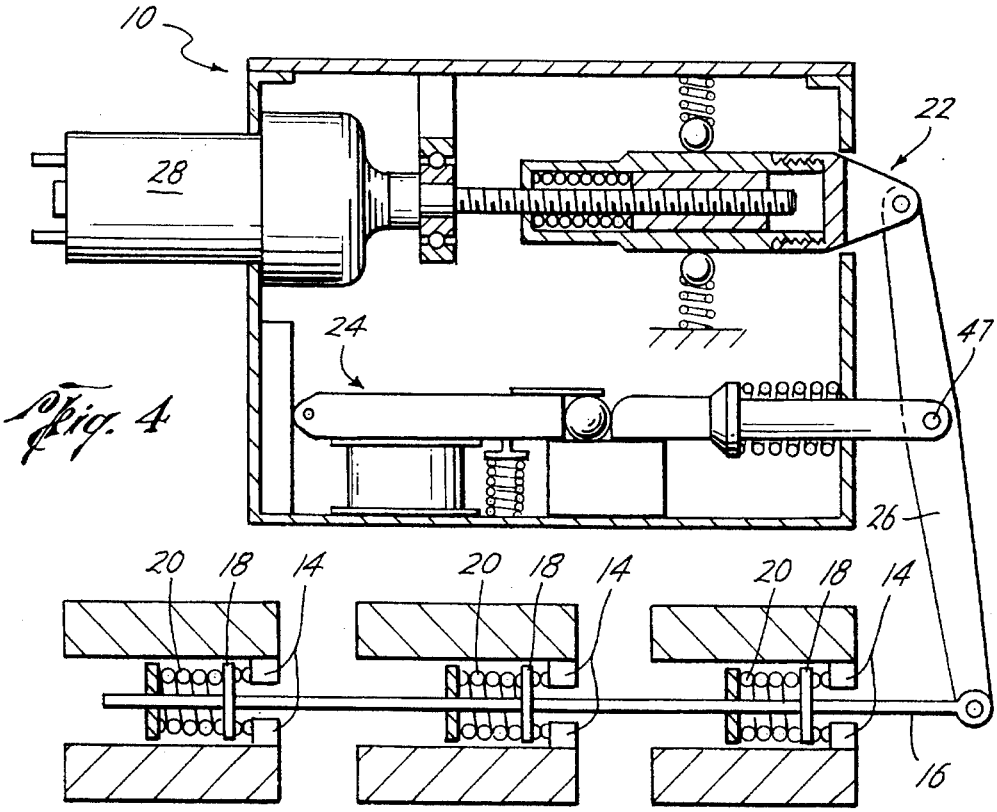
FIG. 4 illustrates schematically a cross-section of a switching accessory in a contacts closed configuration in accordance with the present invention.

Switching accessory 10 may be utilized either as a by-pass accessory or an isolator accessory depending upon whether the switching mechanism is placed in parallel or in series with thyristors 8. For example, as located in FIG. 1 switching accessory 10 provides a means of by-pass of thyristors 8 by providing an electrical connection in parallel with thyristors 8 between the lower and upper bus bar of each bus bar pair 12.1, 12.2 and 12.3. Contact is made with switching accessory 10 between each bar of each bus bar pair in parallel with the thryistors 8 so that electric current is conducted directly to the motor (and by-passes the thryistors). As shown in FIG. 4, the bus bars have contacts 14 projecting therefrom across which electrical contact may be provided in order to provide for the by-pass of the thyristors 8. As such when used as a by-pass, the accessory 10 is activated when a motor has been successfully started, providing for ,direct power supply to the motor via the three pairs of bus bars 12.1, 12.2, and 12.3.

Figure 2:
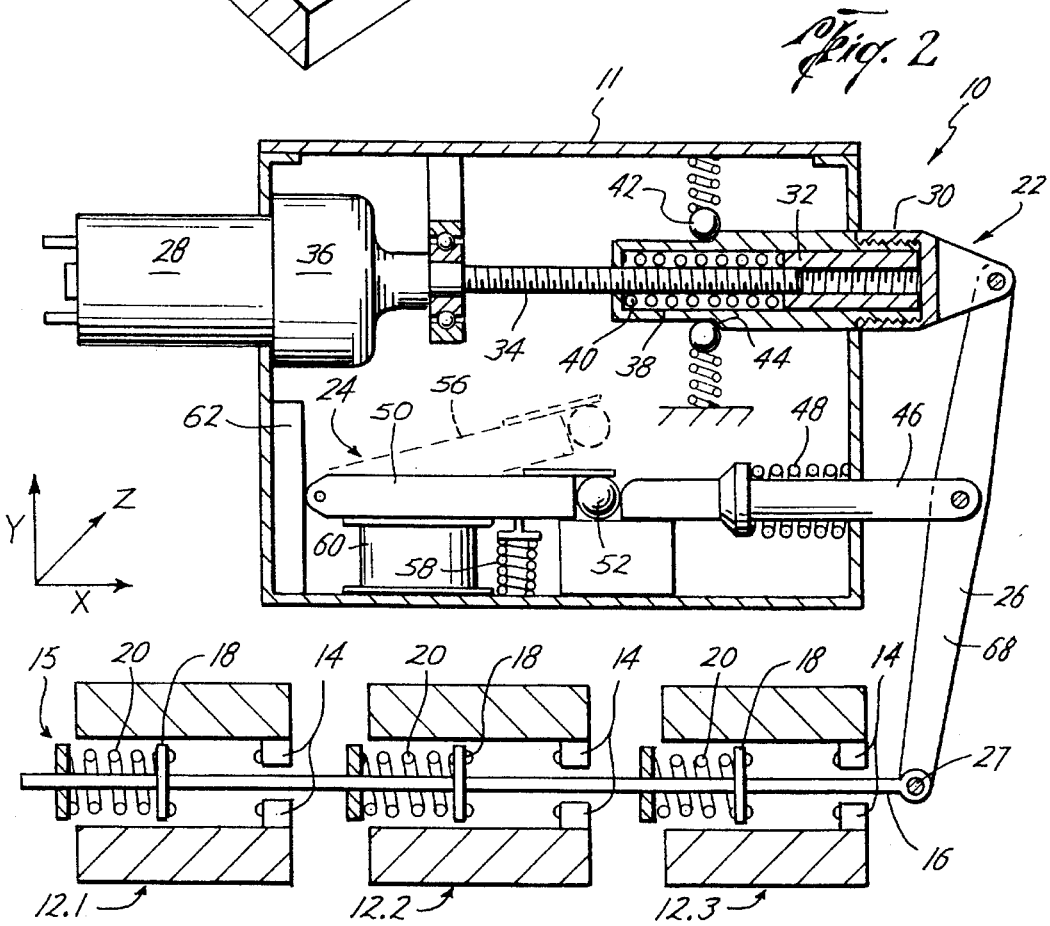
FIG. 2 illustrates schematically a cross-section of a switching accessory in a contacts open configuration in accordance with the present invention.
Figure 3:
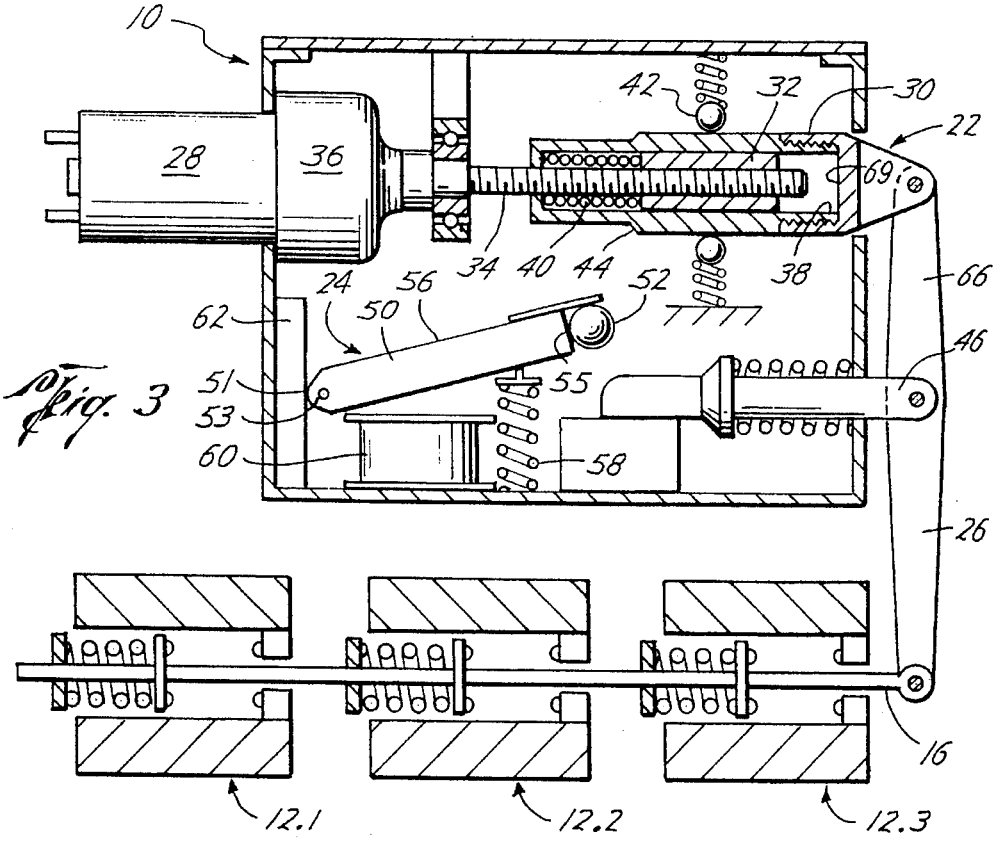
FIG. 3 illustrates schematically a cross-section of a switching accessory in another contacts open configuration in accordance with the present invention.

The operation of switching accessory 10 may be seen with more particularity by reference to FIGS. 2–7. FIGS. 2–5 illustrate a cross-sectional view of switching accessory 10 along section line 2—2 of FIG. 1. The switching accessory generally comprises a pull bar contactor mechanism 15, an actuator mechanism generally indicated by the reference numeral 22, and a fulcrum arrangement generally indicated by the numeral 24, whereby an electrical path between contacts 14 and contact elements 18 can be opened or closed as required. The actuator mechanism 22, the fulcrum arrangement 24 and the pull bar contactor mechanism 15 are disposed in a parallel adjacent configuration with respect to one another and are connected to one another by an operating lever 26, which is pivotally connected thereto in the arrangement as shown in FIGS. 2–4.

Electrical contact between the bus bar pairs 12.1, 12.2, and 12.3 is provided for by a pull bar contactor mechanism (generally shown as reference numeral 15) which comprises a pull bar 16 on which three contact elements 18 are located, the contact elements 18 being urged into contact with the contacts 14 by means of springs 20. This mode of contact and the contact forces acting between the contacts 14 and contact elements 18 are referred to again in detail hereafter. It must be appreciated at this stage that the exact configuration of the pairs of bus bars 12 and their contacts 14 are variable, while still permitting electrical contact between the contacts of the respective pairs of bus bars by a pull bar contactor arrangement in the general configuration as illustrated.

According to the present invention, it is generally desirable to utilize a mechanical contact mechanism including a pull bar which is connected to contacts. One pull bar mechanism 15 is shown generally in FIGS. 2–4, however, a variety of other designs may be utilized. For example, FIG. 6 and FIG. 7 (an expanded view of a portion of FIG. 6) illustrate an alternative pull bar mechanism for connecting bus bars of three pairs of bus bars. In FIGS. 6 and 7, a pull bar mechanism 15 includes contacts 118 and contacts 114. Contacts 114 are connected to the bus bars, thus, when contacts 118 engage contacts 114 electrical conduction between bus bars may occur. FIG. 6 illustrates a top view of pull bar mechanism 15 looking towards the bottom bus bars 12.1, 12.2 and 12.3. As shown in FIG. 6, pull bar mechanism 15 includes a pull bar rod 116 having a male clevis 120 on one end and a nut 122 on the other end. With reference to both FIGS. 6 and 7, pull rod 116 is divided into three sections which are defined by three tubular spacers 124 separated by washers 126. Nut 122 clamps spacers 124 and washers 126 around pull rod 116 as shown in FIG. 6. Each section also has push-off insulators 128, contact insulators 130, a pressure plate 132, teflon guide pins 127, a primary spring 134 and secondary spring 136. As shown in FIG. 6, the push-off insulator 128 adjacent clevis 120 has an end-shoulder stop 140. Stop 140 allows clevis 120 to behave as a pivot point of operating lever 26. FIG. **6*a* illustrates one embodiment for attaching contacts 114 to a bus pair 12.1**. However, the invention may utilize other contact arrangements.

When the contacts are open as shown in FIG. 6, the primary and secondary springs 134 and 136 apply pressure against pressure plates 132 and thus force contacts 118 against push-off insulators 128. As pull rod 116 is pulled to create the initial contact between contacts 118 and 114, primary springs 134 provide the initial contact pressure. As pull rod 116 is further pulled (as described in more detail below), secondary springs 136 produce a much greater final contact pressure.

Teflon guide pins 127 help locate contacts 118 between the bus bars. Because guide pins 127 contact the insulator surrounding each bus bar, Teflon provides a particularly suitable material since Teflon slides easily. Teflon is also compressible, thus, is particularly suitable for the present invention because the distance between bus bars may vary depending on the variations of thryistors which may cause the distance between bus bars to vary.

The actuator mechanism 22 may be designed in a variety of manners. A first embodiment of actuator mechanism 22 is shown in FIG. 2. For illustrative purposes this first embodiment is also shown in FIGS. 3 and 4 to more fully explain the operation of switching accessory 10. However, a second embodiment of actuator mechanism 22 is shown in FIGS. 5 and **5*a* and may be utilized in place of the embodiment shown in FIGS. 2–4**.

As shown in FIG. 2, the actuator mechanism 22 includes a DC electric drive motor 28 that is operable to displace an actuator member 30. The actuator member 30 is slidably located on a nut 32 that engages a threaded shaft 34, the shaft 34 being mechanically connected to the output of the motor 28 via a gear box 36. As such, through rotation of the shaft 34 the nut 32 can be displaced within the bore 38 defined by the actuator member 30. A spring 40 acts between the nut 32 and the actuator member 30 in order to provide for controlled displacement of the actuator member 30 when the nut is displaced towards the motor 28 for the purpose described in rnore detail hereafter.

The actuator mechanism 22 also includes a detent 42. Detent 42 is spring loaded to act against the outer wall of the actuator member 30 and cooperates with a detent shoulder 44 in order to hold the actuator member 30 in a fixed position while displacement of the nut 32 on the shaft 34 occurs. Holding actuator member 30 in a fixed position allows for compression of the spring 40 and subsequent snap displacement of the actuator member for the purpose described in more detail hereinafter, when describing the working of the accessory 10.

Returning again to FIGS. 2–4, the fulcrum arrangement 24 includes a fulcrum shaft 46 that is urged away from the operating lever 26 by a spring 48, the fulcrum shaft 46 being linearly displaceable by the displacement of the operating lever between positions as described in more detail hereafter. The fulcrum arrangement also includes a movable armature member 50 having a roller 52 located at its operative free end. The roller 52, which may be formed from a hardened steel, allows a rolling action to occur between the armature 50, the roller being connected to the armature 50 by a cage. A hardened end of fulcrum shaft 46 is preferably at a right angle to the axis of movement of the fulcrum shaft and has a curved edge as shown to aid the interaction of armature 50 and fulcrum shaft 46. As shown in FIG. 3, the heel 51 of armature mernber 50 contacts a backing plate 62. The heel 51 is preferably concentric to a circle shown as reference numeral 53. Further, the face 55 of armature member 50 is also preferably concentric to the circle 53. This concentric combination helps ensure that the distance between roller 52 and backing plate 62 remains constant during the initial stages of movement of the armature and hence helps to provide low-friction rolling.

A first position of armature 50 is shown by solid lines in FIG. 2 and FIG. 4. The armature member may be displaced to a second position 56 as shown in FIG. 3 and the dotted lines of FIG. 2. A spring 58 urges the armature member 50 towards its second position 56 as illustrated in FIG. 3, whereas an electrically energizable solenoid 60 provides for magnetic forces to be generated and to act on the armature member 50 for holding it in its first position as shown in FIG. 4. The backing plate 62 serves as an effective backing for the armature member 50 in order to permit its secure location in the configuration of FIG. 4, in which it can hold the fulcrum shaft 46 in the position shown. Contact between armature member 50 and backing plate 62 also completes the magnetic path required for the magnetic forces that hold the armature member 50 in its first position.

As illustrated in FIGS. 2 the fulcrum arrangement 24 is oriented such that armature member 50 moves towards and away from the actuator mechanism 22 along the y-axis. However, the present invention is not limited to such an orientation. Fulcrum arrangement 24 may be rotated 90 degrees from the position shown in FIGS. 2–4 such that the movement of armature member 50 moves along the z-axis.

The operation of the switching accessory 10 will be described with reference generally to the components in FIGS. 2–4, however, alternative embodiments of the various components such as shown in FIGS. 5–7 may be used in operation. FIG. 4 illustrates the switching accessory of the invention in its operative configuration in which contact across the pairs of bus bars 12.1, 12.2, and 12.3 is provided. For example, this is the position which is the configuration of the accessory while it by-passes thryistors of a motor starter after a motor has been started or, if the accessory is used as an isolator, while it provides power from the power source to the motor starter (i.e. not isolated).

Generally before the switching accessory 10 is placed in its operative configuration (for example before the starting of a motor), the accessory 10 will be in an inoperative configuration shown in FIG. 3. In the inoperative configuration of FIG. 3, the operating lever is in a datum position. The numeral 66 illustrates the operating lever in its inoperative configuration in which the contact elements 18 will be displaced away from the contacts 14 and the armature member 50 will be in its position as shown by reference numeral 56 of FIG. 3.

With reference to FIGS. 2 and 3, when accessory 10 is to be rendered operative the motor 28 is energized. Prior to energizing the motor 28, the operating lever 26 is in position 66 as shown in FIG. 3. Motor 28 provides for rotation of the shaft 34, which in turn will provide for displacement of the nut 32 towards the end 69 of the bore 38. The rotation of the shaft 34 in this particular direction continues until the nut 32 acts on the end 69 of the bore 38 and displaces the operating lever 26 into its position as shown in FIG. 2 and indicated by the numeral 68.

While the operating lever 26 is moving from position 66 to 68, the spring forces acting on the fulcrum. shaft 46 are such that the operating lever 26 will pivot about a first fulcrum point as provided by the point of connection 27 between the operating lever 26 and the pull bar 16. Pivoting about the point of connection 27 causes the fulcrum shaft 46 to be displaced against the force of the spring 48 away from the backing wall 62. While this occurs the pull bar is in its first position (i.e., no contact) and bears against a stop formation (not shown in FIGS. 2–4) to prevent displacement thereof. The stop formation may be a stop such as end-shoulder stop 140 in FIGS. 6 and 7.

The diisplacement of the lever 26 will continue a sufficient distance until the armature member 50 can be pivotally displaced from its position as shown by numeral 56 in FIG. 3 to its position in FIG. 2. The solenoid 60 is then energized in order to effectively pull the armature 50 into this position in which the roller 52 is effectively located immediately behind the end of the fulcrum shaft 46. When this position has been reached, the detent shoulder 44 will have been displaced beyond the detent 42 as shown in FIG. 2.

After reaching the position shown in FIG. 2, the operation of the motor 28 will be reversed in order to provide for the reverse displacement of the nut 32 with respect to the shaft 34, i.e, towards the motor 28. The reversal of motor 28 may be triggered by a micro switch (not shown) which senses when armature 50 has been pulled into its closed position as shown in FIG. 2. This reverse displacement of the nut 32 towards the motor 28 will displace the actuator member 30 to a position in which the detent 42 will act against the detent shoulder 44, causing the actuator member 30 to be held in this position, even while rotation of the motor continues and the nut 32 is displaced further towards the motor 28.

During this stage, the spring 40 is compressed while the operating lever will effectively remain in its position substantially as shown by the numeral 68, until the force of the spring 40 acting on the actuator member 30 becomes sufficient to overcome the holding force of the detent 42 on the actuator member 30. When the holding force of the detent 42 is overcome, the actuator member 30 is displaced by a snap action into the position substantially as shown in FIG. 4 but with the spring now in the open position and the nut being positioned slightly clear of end 69. The snap action displacement of actuator member 30 causes the operating lever 26 to be pivotally moved about a second fulcrum point 47 provided by the point of connection between the operating lever 26 and the fulcrum shaft 46. Pivoting the operating lever 26 about point 47 will cause the pull bar 16 to be displaced into a position in which its contact elements 18 are brought into contact with the contacts 14 as shown in FIG. 4. The rotation of the shaft 34 can then continue still further, which will cause the spring 40 again to be further compressed, which will cause a further force on the actuator member 30. The further force on actuator member 30 is transmitted to the pull bar 16 via the operating lever 26, thus increasing the contact forces acting between the contact elements 18 and the contacts 14. These contact forces are also effected by the springs 20.

The power of the various springs utilized within the accessory will ensure the effective operation of the complete accessory as will be required in practice. When a required contact force has been reached, the motor 28 will switch off, which will effectively place the accessory 10 in a hold position. This hold position is the position illustrated in FIG. 4. This position will be maintained until contact between contacts 14 and contacts 18 is no longer desired. In order to reduce the power requirements of the solenoid 60 of the accessory, once the accessory has been fully displaced into its operative mode and the motor 28 is switched off, current supply to the solenoid 60 also can be reduced insofar as lesser power will be required for merely holding the armature member 50 in its operative position as shown.

The lever action and fulcrum locking action of the present invention as described above is not limited to the actuator mechanism shown in FIGS. 2–4. Other actuator mechanisms may be utilized to cooperate with the fulcrum arrangement to impart the necessary forces to the lever, and thus, the pull bar. For example, FIGS. 5 and 5*a* illustrate a suitable alternative actuator mechanism 222. FIG. 5 is a plan view of actuator mechanism 222 and FIG. 5*a* is a side view of actuator mechanism 222. As with actuator mechanism 22, actuator mechanism 222 includes an actuator member 230, an actuator nut 232, a threaded shaft 234 connected to an actuator motor (not shown in FIGS. 5 and 5*a*), a detent 242, a detent shoulder 244, a bore 238, a bore end 269, and a clevis 239 for connecting to operating lever 26. Opposite bore end 269 is a washer arrangement 237. Surrounding actuator body 230 is spring 251.

As shown in FIGS. 5 and 5*a*, an anti-rotation pin 233 engages a nut slit 235 within the actuator nut 232 in order to prevent rotation of the actuator nut 232. The pin 233 may slideably engage the nut slit 235 from an end of the nut 232 to a point 239 of the of the nut. Actuator nut 232 is threaded as shown in FIGS. 5 and 5*a* from one end of nut 232 to point 239. The present invention is not limited to the use of an anti-rotation pin and other mechanisms may be used to prevent rotation of nut 232. For example, a square nut and rectangular tubing for the actuator member may be utilized.

The operation of actuator mechanism 222 of FIGS. 5 and 5*a* will be more particularly described with reference to the positions and movements of operating lever 26, fulcrum arrangement 24 and pull bar contactor mechanism 15 in FIGS. 2–4. During the use of a switching accessory 10 having actuator mechanism 222, actuator mechanism 222 is configured as shown in FIG. 5 for the inoperative position 66 of the operating lever 26 such as shown in FIG. 3. In this inoperative position, spring 251 is open as shown in FIG. 5 (however actuator nut 232 is not necessarily displaced fully against the washer arrangement 237 but rather it is sufficient that the actuator nut 232 is simply located in a position between bore end 269 and washer arrangement 237 thus, allowing spring 251 to be open). To operate the switch, the threaded shaft 234 is turned by the actuator motor such that actuator nut 232 is displaced through bore 238 towards bore end 269. When nut 232 engages bore end 269, actuator member 230 is displaced. This in turn displaces the operating lever 26 towards position 68 that is shown in FIG. 2. Detent 242 engages detent shoulder 244 when the operating lever 26 is in position 68.

When the operating lever 26 reaches position 68 and the fulcrum arrangement 24 is locked in the position shown by the solid lines in FIG. 2, the actuator motor reverses. The reverse movement of the actuator motor pulls the actuator nut 232 back through the bore 238 until the actuator nut contacts washer arrangement 237. This position is illustrated in FIG. 5*a*. The reverse movement of the actuator nut continues upon contacting washer arrangement 237. This transmits force through washer arrangement 237 to actuator member 230 and causes detent 242 to release out of shoulder 244. When detent 242 is released from shoulder 244, the force of spring 251 results in a snap action of the actuator member 230 away from the operating lever 26 and the corresponding movement of operating lever 26 from position 68 of FIG. 2 to the contacts closed position of FIG. 4.

The reverse movement of the actuator motor is continued until the actuator nut 232 again contacts washer arrangement 237 and provides additional displacement of the operating lever 26 and pull bar mechanism 15. The additional displacement of the operating lever provides further pressure against the springs of the pull bar mechanism and results in significantly greater contact force. The actuator motor continues its reverse movement until a motor stall is detected electronically, then the motor is shut off. At this point, the actuator mechanism 222 is thus in the position shown in FIG. 5.

The actuator mechanism 222 shown in FIGS. 5 and 5*a* is particularly desirable for use with the pull bar mechanism shown in FIGS. 6 and 7. When the initial snap action of actuator member 230 causes the initial contact of the contacts closed position as described above, the primary springs 134 shown in FIGS. 6 and 7 are compressed. This causes the initial contact pressure. Through the choice of spring strength, a balance may be achieved between the open actuator spring 251 and the primary contact springs 134. After the threaded shaft 234 continues to wind the actuator nut 232 inwards, the nut then presses against the washer arrangement 237 and pulls the actuator member 230 further towards the actuator motor, resulting in further pull bar movement and compression of the somewhat more powerful secondary springs 136. Thus, greater final contact pressures may be achieved.

With reference again to FIGS. 2–4, when contact between contacts 18 and 14 is no longer desired, the power supply to the solenoid 60 is switched off. Interrupting the power to solenoid 60 alllows the spring 58 to displace the armature member 50 from its position as shown in FIG. 4 to its position 56 as shown in FIG. 3, which in turn permits the reverse displacement of the fulcrum shaft 46 under the force of the spring 48. This causes the operating lever 26 to return to its position in which it is aligned with the datum position 66 of FIG. 3. Thus, pull bar 16 is returned to its configuration in which its contact elements 18 are displaced away from the contacts 14.

When used as a by-pass accessory, disconnecting contact elements 18 and contacts 14 will cause immediate reversion of current flow through the thyristors whereafter power to the motor can be shut down, permitting the thyristors to control the shut down. It will be understood also that if motor shut-down is required at any time during the effective activation of the by-pass accessory 10, the power supply to the solenoid 60 need merely be cut, which results in the operating lever returning to this datum position and, therefore, the contact between the contact elements 18 and contacts 14 being broken. This will ensure that motor shut-down can occur at any required time. Likewise, if the accessory is used as an isolator the power supply to the solenoid 60 need merely be cut to result in the contact between the contact elements 18 and contacts 14 to be broken and result in an isolation condition.

When used as an isolator, the accessory of the present invention is connected to three pairs of bus bars that are connected in series with the thyristors of the associated motor starter. The bus bar arrangement is the equivalent of the arrangement of the three pairs of bus bars 12.1, 12.2, and 12.3 and by breaking contact between the bus bars of each pair, motor isolation is provided for. Motor isolation is usually only required in emergency situations, for example, when the thyristors of the motor starter have failed and motor shut-down can thus not be controlled thereby. The power supply to the solenoid of the isolator accessory will thus only be shut down in such emergency situations and the accessory in its normal mode of operation will have its pull bar displaced into the second position (i.e. contacts closed). It is envisaged that either embodiment (isolator or by-pass) may be optionally employed independently of other embodiment.

It will be understood that the exact design of the accessory 10, both as a by-pass accessory and as an isolator accessory is variable while still incorporating the essential features as described and defined above. The present invention includes a lever action and fulcrum pivoting to provide the desired switching characteristics. Particularly useful is the roller action which is supplied between the armature member 50 and the backing plate 62, as well as between the roller 52 and the end of the fulcrum shaft 46, thus ensuring that friction forces cannot interfere substantially with the operation of the accessory. Similar considerations apply between the detent 42 and the detent shoulder 44. however, the detent 42 will have inherent holding friction that as described above is consistent with the operation of the invention.

An advantage of the device of the present invention is the extended switching time and the resulting cost effectiveness. Most cormnercial contactors are solenoid driven and operate several orders of magnitude faster than the device of the invention. The contactors consequently require very much more power to operate and hold and are an unnecessarily costly switching mechanism. Also, the device of the invention allows much greater final contact pressure than is practical with solenoid driven contactors. Furthermore, the complete accessory can be provided in a very compact form while serving the purpose both of a by-pass and an isolator for a motor.

For example, a large solenoid typically requires six kilowatts instantaneously to energize it and 150 watts to hold the solenoid. Such a solenoid would activate in a few milliseconds causing high impact forces and a final contact force of about 20 pounds per set of contacts. According to the present invention, contacts may be closed with a power supply of 20 watts and a holding power of 2 watts. The closure may occur in two stages. The initial closure force is light and thus minimizes impact damage to the contacts. The final stage which follows shortly after the initial closure can easily be made considerably higher than is practical with the solenoid while still avoiding high impact damage. Consequently, a much better contact may be achieved.

In addition, the arrangement of the present invention allows the use of smaller power supplies such as a switched mode power supply as opposed to conventional transformer power supplies. Such switch mode power supplies have advantages in cost, volume, and voltage insensitivity. Furthermore, the present invention allows the overall switch accessory to be more compact, generate less heat, and provide higher contact pressures than is possible with a solenoid.

It will be recognized that the present invention is operable particularly in conjunction with a thyristor-type motor starter having three pairs of thyristors. The thyristors may be connected between the bus bars of three pairs of bus bars which are associated with the three phases of a three-phase electric power supply. The three pairs of bus bars are arranged in a parallel adjacent relationship with respect to one another, the bus bars of each pair having contacts extending therefrom in a configuration which permits a contactor arrangement extending between the pairs of bus bars. However, the present invention may be utilized with other types of motor starters and other types of bus bar arrangements.

As the general configuration of an electric motor and the operation of such a motor are well known and as these do not form a part of the present invention, these are not described herein. Those skilled in the art will recognize that the specific configuration of the present invention can be adapted to accommodate a wide variety of motors, particularly insofar as specific design parameters are concerned in order to ensure the effective operation thereof. Particularly, the specific design of the accessory 10 can vary when required to be used in association with different motors. Moreover, the present invention may be utilized without being associated with a motor or motor starter. Thus, the present invention may be utilized simply as a switch for a variety of applications.

What is claimed is:

1. A motor starter allowing the bypass of at least one current control element, comprising:

at least two bus bars said at least one current control element electrically connecting at least two of said at least two bus bars;

a lever;

at least one contact element for providing a bypass current path around said at least one current control element, said at least one contact element connected to said lever, said contact element physically positioned between said bus bars in proximity of contact locations of said bus bars;

at least one pivot point about which said lever may pivot to at least two positions, a first position in which said contact element is electrically isolated from said bus bars and a second position in which said contact element is electrically connected to said bus bars at said contact locations;

a pull bar, said lever and at least one contact element connected to said pull bar, at least a portion of said pull bar physically positioned between said bus bars; and a motor connected to said lever for driving said lever.

2. The starter of claim 1, said pull bar being moveable in a direction along_the length of said pull bar to connect said at least one contact element and said contact locations.

3. The starter of claim 2, further comprising:

a moveable fulcrum connected to said lever.

4. A switching accessory mounted on a motor starter, comprising:

a lever;

at least one movable contact element connected to said lever, said contact element movable to a position in which said contact element electrically connects at least two bus bars of said motor starter;

a drive mechanism for moving said lever;

a fulcrum shaft about which said lever may pivot, said fulcrum shaft movable between a first position and a second position, said lever pivotable about said fulcrum shaft when said fulcrum shaft is secured in said second position.

5. The switching accessory of claim 4, further comprising: a fulcrum locking mechanism, said mechanism comprising:

a support plate, and a movable member movable to a member first position between said fulcrum shaft and said support plate, said movable member securing said fulcrum shaft when said movable member is positioned in said member first position.

6. The switching accessory of claim 5, wherein said movable member is an armature, said armature movable into said member first position by magnetic force.

7. The switching accessory of claim 6, further comprising:

an armature spring acting on said armature for moving said armature away from said member first position.

8. The switching accessory of claim 4, further comprising:

a pull bar upon which said at least one movable contact element is mounted, said pull bar being pivotably connected to said lever.

9. A motor starter comprising:

a pull bar that is axially displaceable between at least one pair of bus bars, the pull bar being displaceable between a first position in which contacts of the bus bars of each at least one pair are isolated from one another and a second position in which the contacts of the bus bars of each pair are in electrical contact via contact elements on the pull bar;

a motor driven actuator mechanism, said actuator mechanism including an actuator member that is displaceable between predetermined limit positions;

a fulcrum shaft that is displaceable between predetermined limit positions; and an operating lever which is pivotally connected to the pull bar, the actuator member and the fulcrum shaft.

10. A method of switching electrical current through a motor starter, comprising:

providing at least one pair of bus bars, each of said bus bars having a bus bar contact;

pivotally connecting a pull bar, a fulcrum shaft, and a lever, said pull bar having contact elements, pivotally displacing said lever about a first fulcrum point provided by the point of connection between the pull bar and the operating lever, displacing said fulcrum shaft from a first position to an operating position;

pivotally displacing said lever about a second fulcrum point provided by the point of connection between the pull bar and the fulcrum shaft; and contacting said bus bar contacts and said pull bar contact elements for allowing electrical conduction between said bus bars of said bus bar pair.

11. The method of claim 10, said method further comprising:

holding said fulcrum shaft in said operating position

12. The method of claim 11, wherein said fulcrum shaft is held in said operating position by a movable armature.

13. The method of claim 10, said method further comprising:

pivotally connecting said lever and an actuator mechanism, said actuator mechanism including a movable member;

pivoting said lever about said first fulcrum point by moving said movable member;

holding said movable member in an actuator holding position;

providing a biasing force against said movable member while said movable member is held in said holding position; and pivoting said lever about said second fulcrum point by moving said movable member from said holding position by increasing said biasing force.

14. A switching apparatus having bus bars, said apparatus for starting an electric motor and conaprising:

a pull bar having contactors spaced along its length and configured to connect said bus bars when said pull bar is moved along its length from a first position to a second position; and a mechanical mechanism operable to quickly move said pull bar from its first position to its second position, said mechanism including:

(1) a lever having a first end, a second end, and a central fulcrum, said lever pivotally connected at said first end to said pull bar for moving said pull bar to said second position;

(2) a fulcrum support connected to said central fulcrum of the lever; and (3) a quick release mechanical energy source coupled to the second end of the lever and operable upon release to drive said second end so as to move said first end and thereby said pull bar to said second position.

15. The switching apparatus of claim 14, said fulcrum support being movable between a first fulcrum support position and a second fulcrum support position.

16. The switching apparatus of claim 15, further comprising:

a locking mechanism, said locking mechanism holding said fulcrum support in said second fulcrum support position.

17. A switching apparatus having sets of bus bars, said apparatus for starting an electric motor and cornprising:

a contactor pull bar, a fulcrum bar and an actuator member mounted generally parallel, having corresponding first and second ends, and being reversibly and longitudinally movable between corresponding retracted positions and extended positions with said extended positions being in the same direction as said first ends;

an operating lever pivotally connected at a first end to the first end of the actuator member, at a second end to the first end of the pull bar, and at a point between the ends of the lever to the first end of the fulcrum bar; and a plurality of electrical contactors spaced along and mounted on the pull bar in a configuration to contact contactor sites on said bus bars to form electrical contact between said sets of bus bars when said pull bar is in its extended position, said actuator member, said fulcrum bar and said pull bar being normally in their retracted positions when said contactors are in an open position.

18. The switching apparatus of claim 17, further comprising:

a locking member operable when said fulcrum bar is in its extended position to lock the fulcrum bar in its extended position.

19. The switching apparatus of claim 18, further comprising:

a first biasing member normally biasing said actuator member toward its retracted position;

a second biasing member normally biasing said fulcrum bar toward its retracted position;

a holding member operably associated with said actuator member to hold the actuator member in an extended position against the bias of said first biasing member; and a reversible drive member coupled to said actuator member, said drive member being driveable in a first direction to move said actuator member to its extended position in cocked relation with said holding member and also to pivot said lever about said first end of said pull bar so as to move said fulcrum bar to its extended position, and driveable in an second direction to release said actuator member from said cocked relation for movement of said actuator member toward its retracted position responsive to said first biasing member so as to pivot said lever about said first end of said fulcrum bar and move said pull bar into its extended position thereby closing said contactors.

20. A method of switching electrical current through a plurality of bus bars of a motor starter with a switch to allow current to flow in a bypass manner around at least one current control element of said motor starter, said method comprising:

providing said at least one current control element, said current control element electrically connected to at least two of said plurality of bus bars;

providing a plurality of electrical contactors, each of said contactors have a first and second contact element, electrical current flowing through said contactors to said bus bars when said contactors are closed such that said first contact element is connected to said second contact element, said current flow through said contactors providing a current bypass route between said bus bars and around said current control element;

driving said first contact elements towards said second contact elements with a first contact force;

connecting said first and second contact elements when said first contact force is being applied between said first and second contact elements; and applying a second contact force between said first and second contact elements after said connecting step to hold said first and second contact elements in a contact state, said second contact force having a greater magnitude than said first contact force.

21. The method of claim 20, further comprising:

storing energy in an energy storage element after activating said switch; and releasing said stored energy to form said contact force.

22. The method of claim 21, said method being a slow acting switching method.

23. The method of claim 22, said storing energy step being a longer time than said driving step such that said slow acting switching method has a snap action closure of said first and second contact elements.

24. The method of claim 23, further comprising:

providing a snap action opening force to allow a quick disconnect of said first and second contact elements.

25. The method of claim 20, wherein said current control element is a thyristor and said method being a slow acting switching method.

26. A method of switching an electrical current in a plurality of bus bars of a motor starter with a switch to allow current to flow in a bypass manner around at least one current control element of a motor starter, said method comprising:

providing said at least one current control element, said current control element electrically connected to at least two of said plurality of bus bars;

providing a plurality of first contact locations on said bus bars;

providing at least one moveable contact element, said moveable contact element switching a current flow in said bus bars when said moveable contact element contacts said first contact locations, so that said current flow flows between said bus bars while bypassing said at least one current control element;

activating said switch when a change in said current flow is desired; and slowly implementing said change in said current flow after said switch is activated.

27. The method of claim 26, further comprising:

storing energy in an energy storage element after activating said switch; and releasing said stored energy to form said contact force, said storing energy step being a longer time than said releasing step such that a snap action closure between said first contact elements location and said moveable contact occurs.

28. The method of claim 27, said energy created by an electric motor which transfers energy via a motor shaft to said storage element.

29. The method of claim 28, said current control element being a thyristor and said energy storage element being a spring.

30. The method of claim 27 further comprising:

disconnecting said first contact locations and said moveable contact elements with a quick snap action.

31. The method of claim 26, further comprising:

connecting said first contact locations and said moveable contact element with a contact force applied between said first contact locations and said moveable contact elements; and

* * * * *

UNITED STATES PATENT AND TRADEMARK OFFICE

CERTIFICATE OF CORRECTION

PATENT NO. : 5,530,414

DATED : June 25, 1996

INVENTOR(S) : Stanford W.G. Reynolds

It is certified that error appears in the above-identified patent and that said Letters Patent is hereby corrected as shown below:

In claim 11, column 13, line 52, after "position" insert --.--.

In claim 14, column 14, line 5, delete "conaprising" and insert --comprising-- therefor.

In claim 31, column 16, line 49, add the following element:
--applying a holding contact force between said first contact locations and said moveable contact elements after said connecting step, said holding contact force having a greater magnitude than said first contact force.--

Signed and Sealed this

Eighth Day of October, 1996

Bruce Lehman

*Attest:*

BRUCE LEHMAN

*Attesting Officer*

*Commissioner of Patents and Trademarks*